US010119710B2

(12) United States Patent
Wang

(10) Patent No.: US 10,119,710 B2
(45) Date of Patent: Nov. 6, 2018

(54) HEAT EXCHANGE SYSTEM USING AN EXTERNAL ROTOR MOTOR

(71) Applicant: Zhongshan Broad-Ocean Motor Co., Ltd., Zhongshan (CN)

(72) Inventor: Xiongcheng Wang, Zhongshan (CN)

(73) Assignee: ZHONGSHAN BROAD-OCEAN MOTOR CO., LTD., Zhongshan (CN)

( * ) Notice: Subject to any disclaimer, the term of this patent is extended or adjusted under 35 U.S.C. 154(b) by 170 days.

(21) Appl. No.: 14/967,404

(22) Filed: Dec. 14, 2015

(65) Prior Publication Data

US 2016/0097548 A1 Apr. 7, 2016

Related U.S. Application Data

(63) Continuation-in-part of application No. 12/876,147, filed on Sep. 5, 2010, now abandoned.

(30) Foreign Application Priority Data

Sep. 30, 2009 (CN) ..... 2009 2 0236976 U

(51) Int. Cl.

| | |
|---|---|
| ***F25D 17/06*** | (2006.01) |
| ***F24F 1/14*** | (2011.01) |
| ***F24F 1/38*** | (2011.01) |
| ***F24F 1/16*** | (2011.01) |
| ***F24F 1/50*** | (2011.01) |
| ***F04D 25/06*** | (2006.01) |
| ***F04D 29/66*** | (2006.01) |

(52) U.S. Cl.

CPC ..... *F24F 1/14* (2013.01); *F04D 25/0613* (2013.01); *F04D 29/668* (2013.01); *F24F 1/16* (2013.01); *F24F 1/38* (2013.01); *F24F 1/50* (2013.01)

(58) Field of Classification Search

CPC ..... F24F 1/50; F24F 1/14; F24F 1/16; F24F 1/18; F24F 1/38; F24F 1/56; F24F 1/40; B63H 1/14; F04D 29/668; F04D 25/0613

USPC ..... 310/51

See application file for complete search history.

(56) References Cited

U.S. PATENT DOCUMENTS

| | | | | |
|---|---|---|---|---|
| 4,723,419 A * | 2/1988 | Kessler | F24F 1/38 | 165/145 |
| 4,908,929 A * | 3/1990 | Fazi, Jr. | F16F 15/08 | 29/469.5 |
| 6,024,537 A * | 2/2000 | Moreau | F04D 29/326 | 416/169 A |
| 6,250,884 B1 * | 6/2001 | Huang | F04D 25/088 | 416/207 |

(Continued)

*Primary Examiner* — Ana Vazquez

(74) *Attorney, Agent, or Firm* — Matthias Scholl, PC; Matthias Scholl

(57) ABSTRACT

A heat exchange system of the invention includes at least multiple grids, a blower including an external rotor motor and a wind blade, an inner side wall, a shock absorbing pad, a compressor, and a box having multiple exhaust inlets. The exhaust inlets are disposed on the side of the box. The grids are disposed at an exhaust outlet of the box. The blower is disposed in the box and below the grid. The compressor is disposed on a bottom surface in the box. The blower is an external rotor axial fan, and the wind blade is disposed outside a rotor of the external rotor motor. The shock absorbing pad is disposed between the grids and the external rotor motor.

17 Claims, 11 Drawing Sheets

(56) References Cited

U.S. PATENT DOCUMENTS

2005/0287005 A1* 12/2005 Gruber ..... F04D 25/0613
416/244 R

* cited by examiner

HEAT EXCHANGE SYSTEM USING AN EXTERNAL ROTOR MOTOR

CROSS-REFERENCE TO RELATED APPLICATIONS

This Application is a continuation-in-part of, and claims domestic priority benefits to U.S. patent application Ser. No. 12/876,147, filed Sep. 5, 2010, now pending. Pursuant to 35 U.S.C. § 119 and the Paris Convention Treaty, U.S. patent application Ser. No. 12/876,147, filed Sep. 5, 2010, now pending, claims the benefit of Chinese Patent Application No. 200920236976.3 filed on Sep. 30, 2009. The contents of all of the aforementioned applications, including any intervening amendments thereto, are incorporated herein by reference in their entirety.

CORRESPONDENCE ADDRESS

Inquiries from the public to applicants or assignees concerning this document should be directed to: Matthias Scholl P.C., Attn.: Dr. Matthias Scholl Esq., 245 First Street, 18th Floor, Cambridge, Mass. 02142.

BACKGROUND OF THE INVENTION

Field of the Invention

The invention relates to a heat exchange system.

Description of the Related Art

FIG. 1 is a schematic view of a heat exchange system in the related art. In this heat exchange system of an outdoor fan unit for an air conditioner, multiple grids 1 are disposed at an exhaust outlet 6 of a box 4, a blower 2 is disposed in the box 4 and below the grid 1, and the blower 2 comprises a drive motor 7, and a wind blade 9 or a wind wheel disposed on a motor shaft 8 of the drive motor 7. Problems with the system are: 1) rotational inertia of the drive motor 7 of the blower 2 is small, the wind blade 9 of the blow 2 is far away from the exhaust outlet 6, and thus having a high wind pressure coefficient, large wind resistance, and low efficiency, which causes the blower 2 to blow small amount of wind from the exhaust outlet 6 of the box 4, and thus an ideal blowing effect cannot be facilitated; 2) the drive motor 7 of the blower 2 has large fluctuation in rotating torsion, namely large resonance, which causes the wind blade 9 or the wind wheel to rotate unstably, and affects blowing effects; 3) the heat exchange system employing the blower structure is low efficient and power consuming, and cannot meet requirement of the current society for energy conservation and environmental protection.

SUMMARY OF THE INVENTION

In view of the above-described problem, it is one objective of the invention to provide a heat exchange system that features simple structure, low cost, large air output, and good blowing effect, and is high efficient and power saving.

To achieve the above objectives, in accordance with one embodiment of the invention, provided is a heat exchange system, comprising multiple grids, a blower comprising an external rotor motor and a wind blade, an inner side wall, a shock absorbing pad, a compressor, and a box comprising a side, a bottom surface, an exhaust outlet, and multiple exhaust inlets. The exhaust inlets are disposed on the side of the box, the grid is disposed at the exhaust outlet of the box, the blower is disposed in the box and below the grid, the compressor is disposed on the bottom surface of the box, the blower is an external rotor axial fan, and the wind blade is disposed outside a rotor of the external rotor motor. The external rotor motor comprises an axis, and the wind blade comprises an outer surface, a top end, and a side end. The shock absorbing pad is disposed between the multiple grids and the external rotor motor.

In a class of this embodiment, the wind blade is disposed outside the rotor of the external rotor motor via a support, the support comprises an annular cylinder, and multiple mounting feet extending from the annular cylinder, the wind blade is disposed on the mounting foot, and the annular cylinder is fit on the rotor of the external rotor motor.

In a class of this embodiment, the wind blade is an equal-width blade and in the vicinity of the exhaust outlet of the box.

In a class of this embodiment, the annular cylinder is an integral formed cylinder, or a cylinder formed via an annular body with an opening.

In a class of this embodiment, an inner wall of the annular cylinder is interference fit with an outer wall of the rotor.

In a class of this embodiment, a screw hole is disposed on the mounting foot, and the wind blade is disposed on the mounting foot via a bolt and a nut.

In a class of this embodiment, a through hole is disposed on the mounting foot, and the wind blade is connected to the mounting foot via a rivet.

In a class of this embodiment, the wind blade is directly welded on the mounting foot, or directly welded on the outside of the rotor of the external rotor motor.

In a class of this embodiment, the wind blade is disposed on the mounting foot via buckling In a class of this embodiment, the annular cylinder and the mounting foot are integrally formed, or connected to each other as two independent parts via welding, buckling, or riveting.

In a class of this embodiment, the shock absorbing pad is in the shape of a circular ring and comprises a plurality of holes; and a groove for receiving wires is disposed on an inner wall that confines each of the plurality of holes.

In a class of this embodiment, a plurality of screws are respectively disposed in the plurality of holes for connecting the shock absorbing pad, the external rotor motor, and the multiple grids to one another; and a distance between the center of the shock absorbing pad and each of the plurality of screws is smaller than the external radius of the rotor of the external rotor motor.

In a class of this embodiment, the number of the plurality of holes is four; and the number of the plurality of screws is four.

In a class of this embodiment, the outer surface and the axis of the external rotor motor form an oblique angle.

In a class of this embodiment, an air collecting ring is disposed between the wind blade and the inner side wall and encloses the wind blade; and substantially one third of the wind blade along the axis of the external rotor motor is disposed inside the air collecting ring.

In a class of this embodiment, the side end of the wind blade is spaced from the air collecting ring by 8-15 mm.

In a class of this embodiment, the top end of the wind blade is spaced from the multiple grids by 80-140 mm.

In a class of this embodiment, the top end of the wind blade is spaced from the multiple grids by 110 mm.

In a class of this embodiment, the bolt comprises an axis, and the axis of bolt and the axis of the external rotor motor form an angle of substantially 45°.

Advantages of the invention comprise:

1) the blower uses the external rotor axial fan, the rotor thereof features large rotational inertia, small fluctuation in torsion, and stable operation, and the wind blade is close to the exhaust outlet and has a low wind pressure coefficient, small wind resistance, and high efficiency, which causes the external rotor axial fan to blow large amount of wind from the exhaust outlet of the box and thus improving blowing effect; 2) the heat exchange system features high overall efficiency and low power consumption, and meets requirement of the current society for energy conservation and environmental protection; 3) the wind blade is an equal-width blade with a large area and in the vicinity of the exhaust outlet of the box, and thus greatly improving inducing capacity of the external rotor axial fan, and blowing effect of the heat exchange system; 4) the annular cylinder on the support is fit on a housing of the rotor of the external rotor motor, and the inner wall of the annular cylinder is interference fit with the outer wall of the rotor, which make the invention have simple assembling, reliable connection, high production efficiency, low processing difficulty, and reduced production cost; 5) the external rotor axial fan is combined and features simple installation and disassembly, and the external rotor motor and the wind blade can be transported separated, which reduces transportation cost; 6) by using the external rotor axial fan, overall volume of the heat exchange system and system cost are reduced; 7) the shock absorbing pad, the multiple grids, and the external rotor motor are configured such that the external rotor motor is connected to the multiple grids in a stable manner and the oscillations of the external rotor motor are reduced during operation; 8) the air collecting ring and the wind blade are configured so that substantially no turbulence is generated between the wind blade and the multiple grids, thus increasing the heat exchange efficiency of the heat exchange system; 9) the distance between the center of the shock absorbing pad and each of the plurality of screws is smaller than the external radius of the rotor of the external rotor motor; therefore, the plurality of screws connect the shock absorbing pad, the external rotor motor, and the multiple grids to one another in a stable manner; 10) the axis of bolt and the axis of the external rotor motor form an angle of substantially 45°; therefore, oscillations in the direction perpendicular to the axis of the external rotor and oscillations in the direction parallel to the axis of the external rotor are eliminated, and the bolt connects the external rotor motor and the multiple grids to one another in a stable and balanced manner; and 11) the structural arrangements of the wind blade, the air collecting ring, and the multiple grids reduce the wind resistance, eliminate the turbulence between the wind blade and the multiple grids, and increase the air flow during operation.

DETAILED DESCRIPTION OF THE EMBODIMENTS

Figure 1:
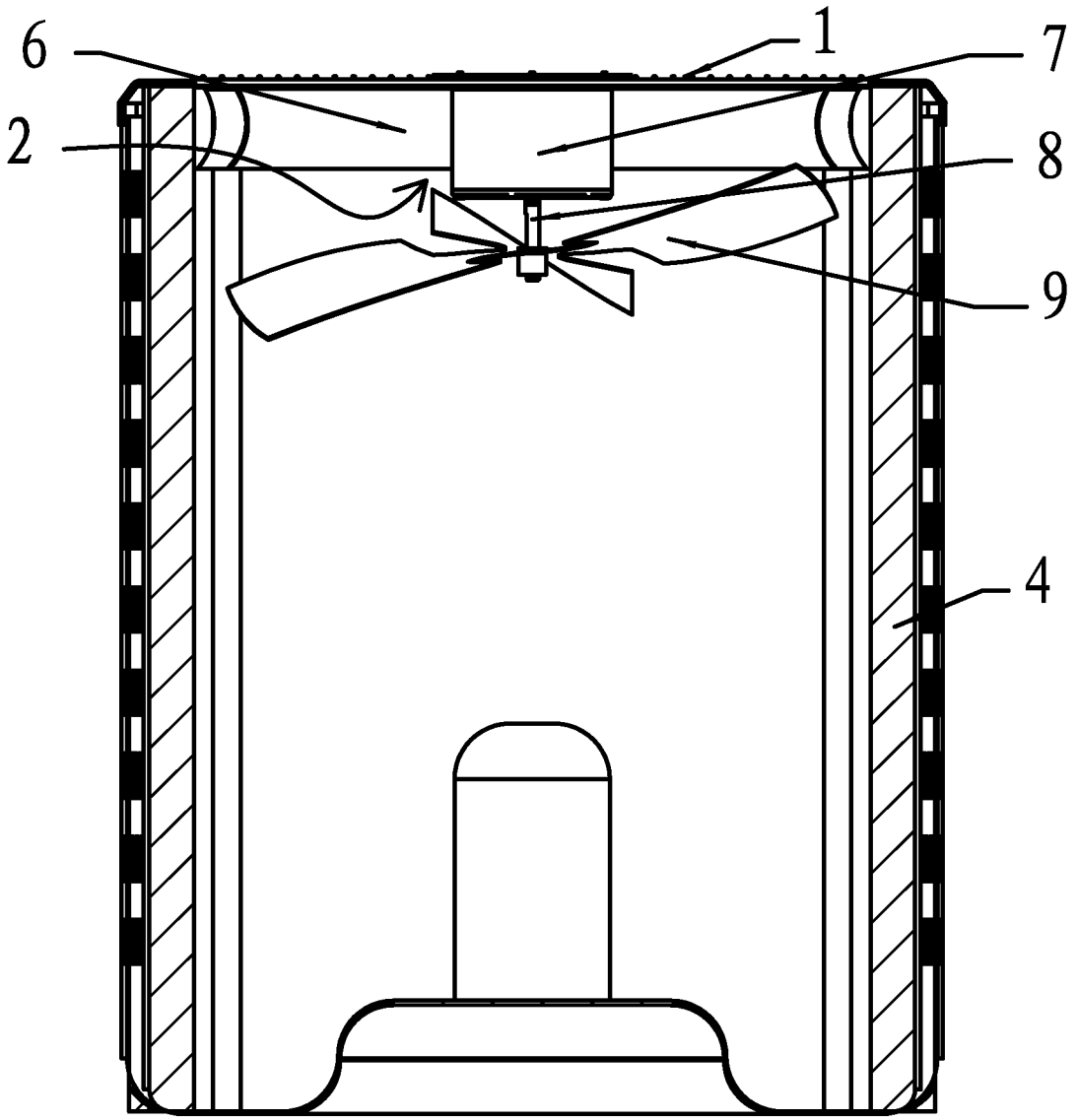
FIG. 1 (Related Art)
FIG. 1 is a schematic view of a heat exchange system in the related art.
Figure 2:
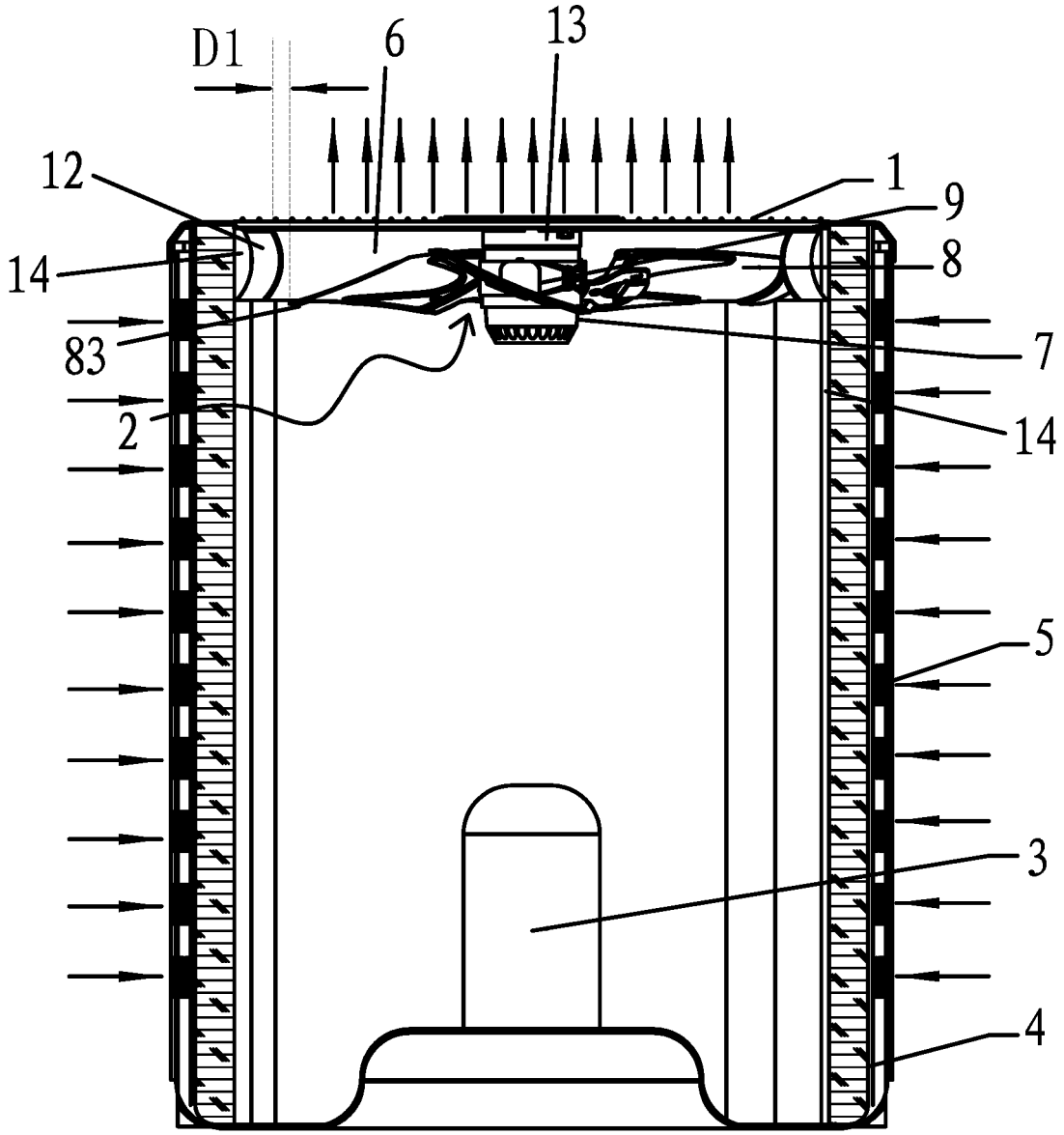
FIG. 2 is a schematic view of a heat exchange system of an exemplary embodiment of the invention.
Figure 3:
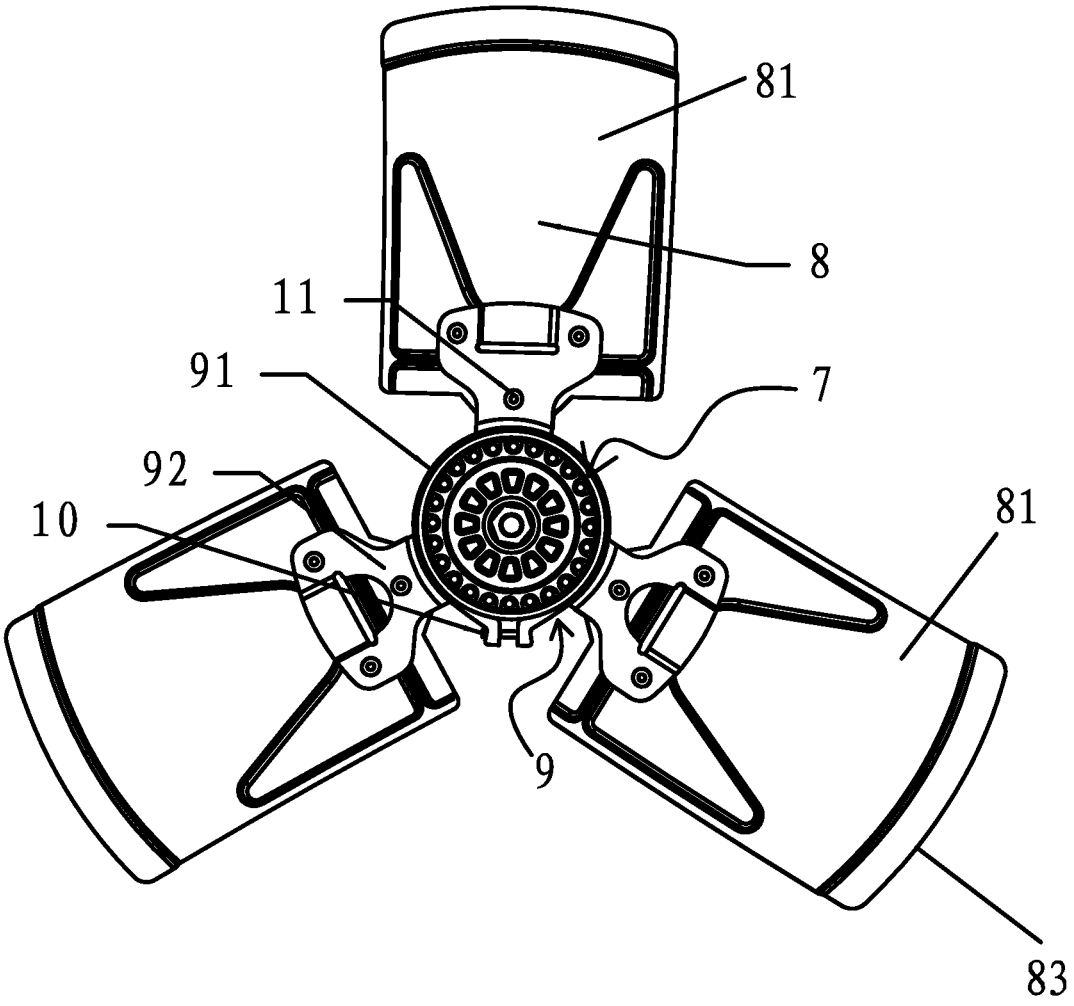
FIG. 3 is a schematic view of an external rotor axial fan in FIG. 2.
Figure 4:
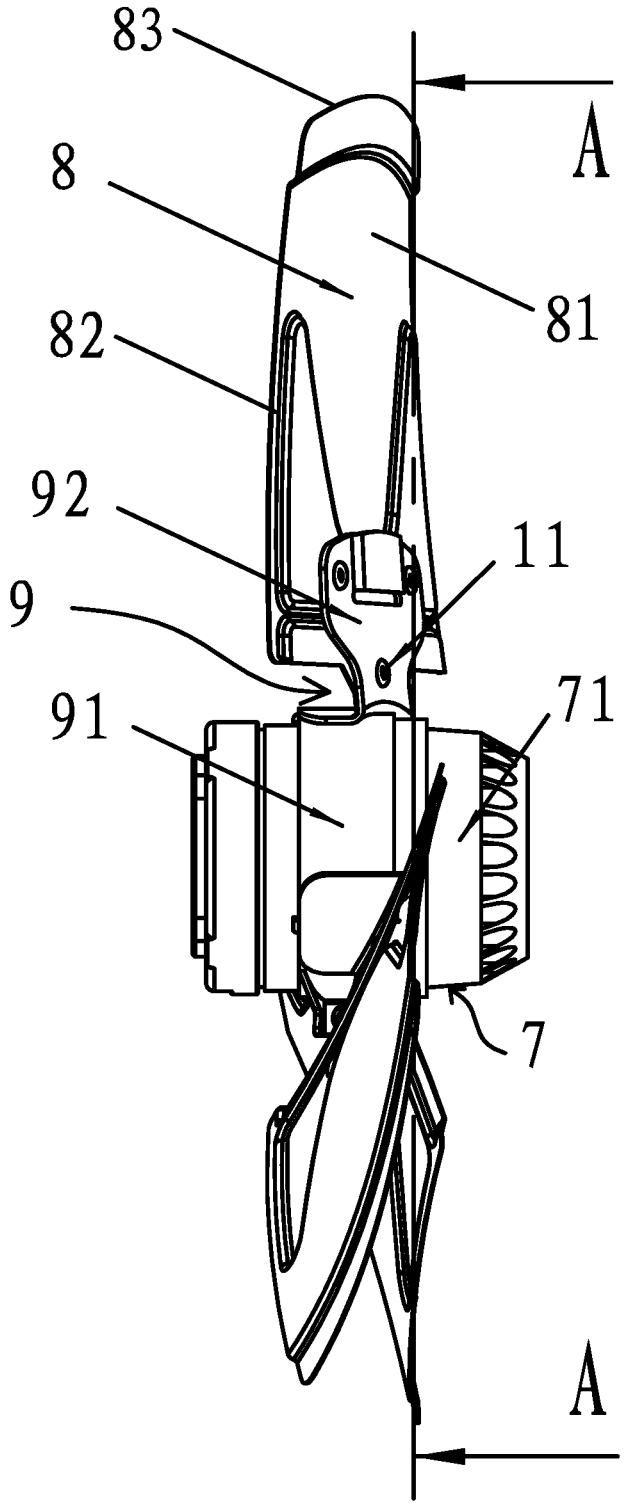
FIG. 4 is another schematic view of the external rotor axial fan in FIG. 3.

Further description of the invention will be given below in conjunction with specific embodiments and accompanying drawings.

As shown in FIGS. 2-11, a heat exchange system of the invention comprises multiple grids 1, a blower 2, an inner side wall 14, a shock absorbing pad 13, a compressor 3, and a box 4 having multiple exhaust inlets 5 on the side thereof. The grid 1 is disposed at an exhaust outlet 6 of the box 4, the blower 2 is disposed in the box 4 and below the grid 1, and the compressor 3 is disposed on the bottom surface of the box 4. The blower 2 is an external rotor axial fan, and comprises an external rotor motor 7 and a wind blade 8, and the wind blade 8 is disposed outside a rotor 71 of the external rotor motor 7. The external rotor motor 7 comprises an axis, and the wind blade 8 comprises an outer surface 81, a top end 82, and a side end 83. The shock absorbing pad 13 is disposed between the multiple grids 1 and the external rotor motor 7.

Figure 5:
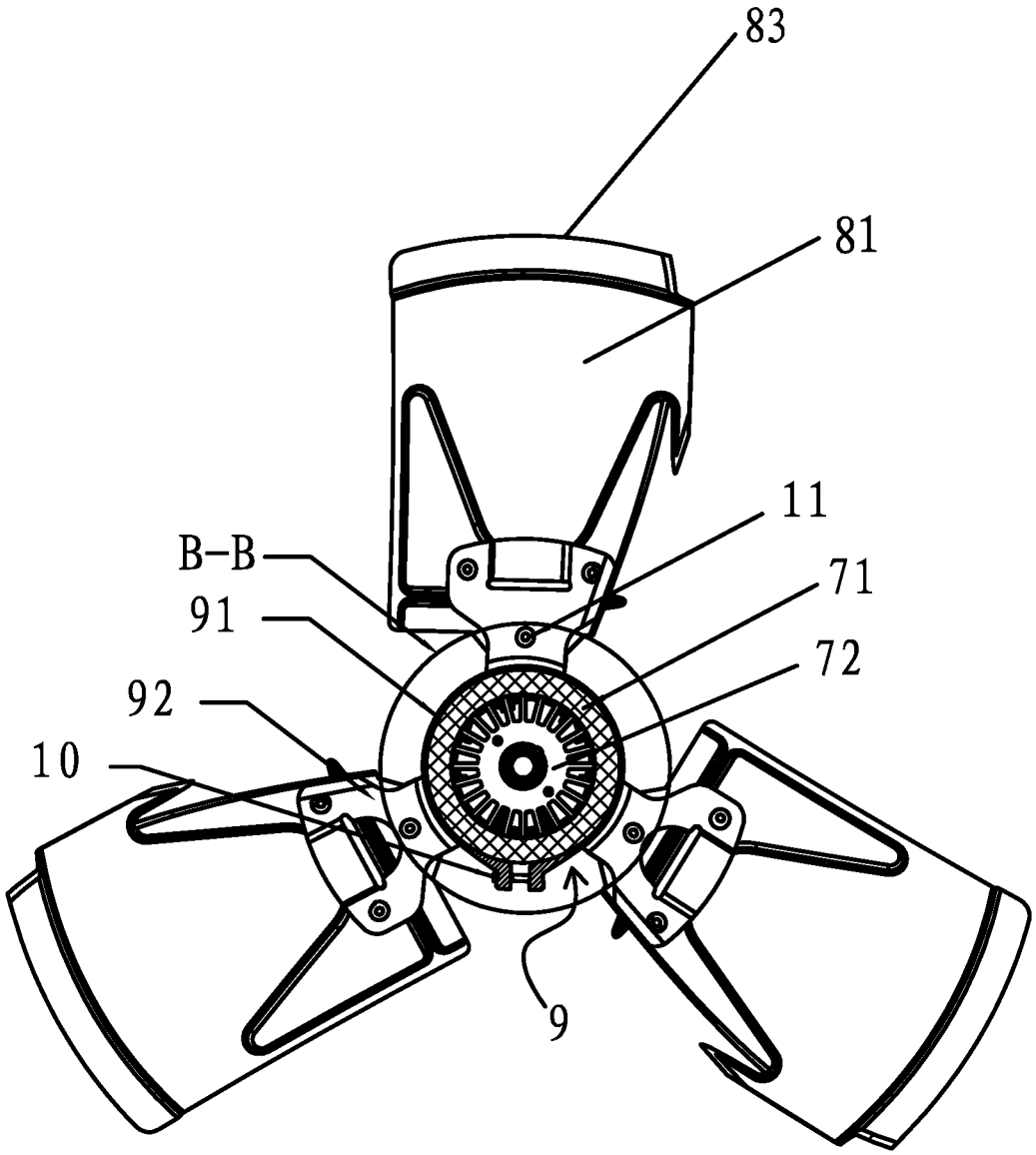
FIG. 5 is a cross-sectional view of FIG. 4 along a line A-A.
Figure 6:
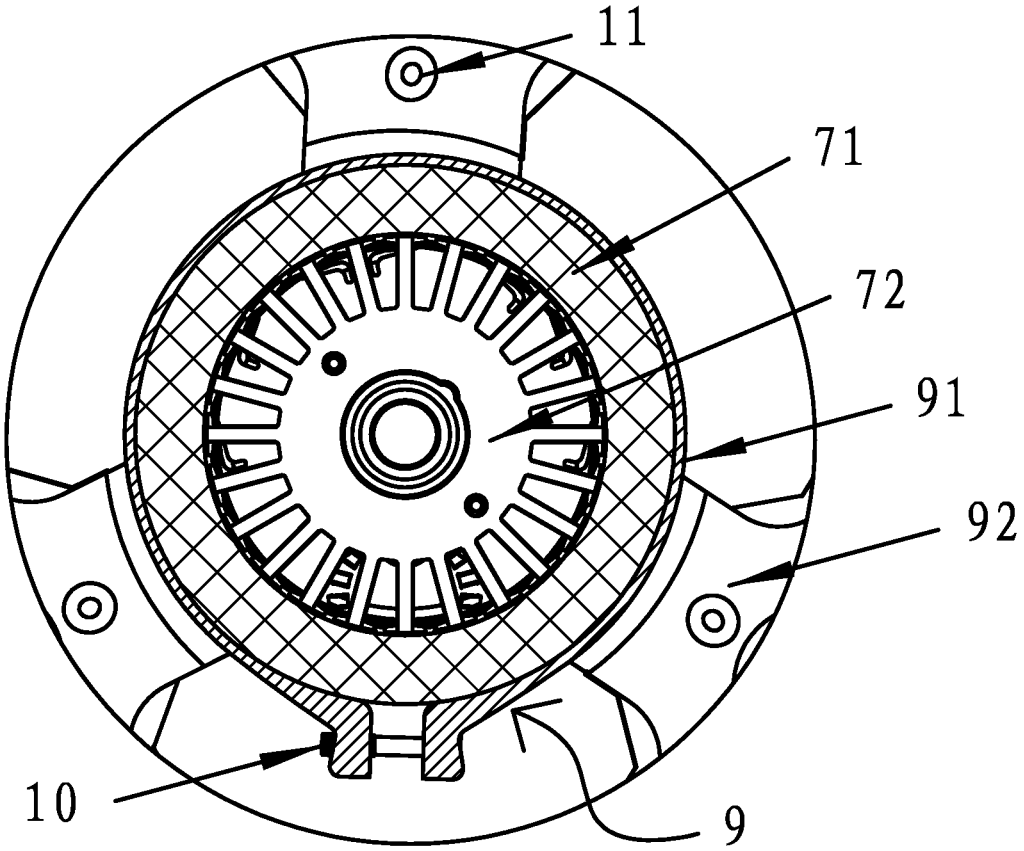
FIG. 6 is an enlarged view of FIG. 5 along a line B-B.
Figure 7:
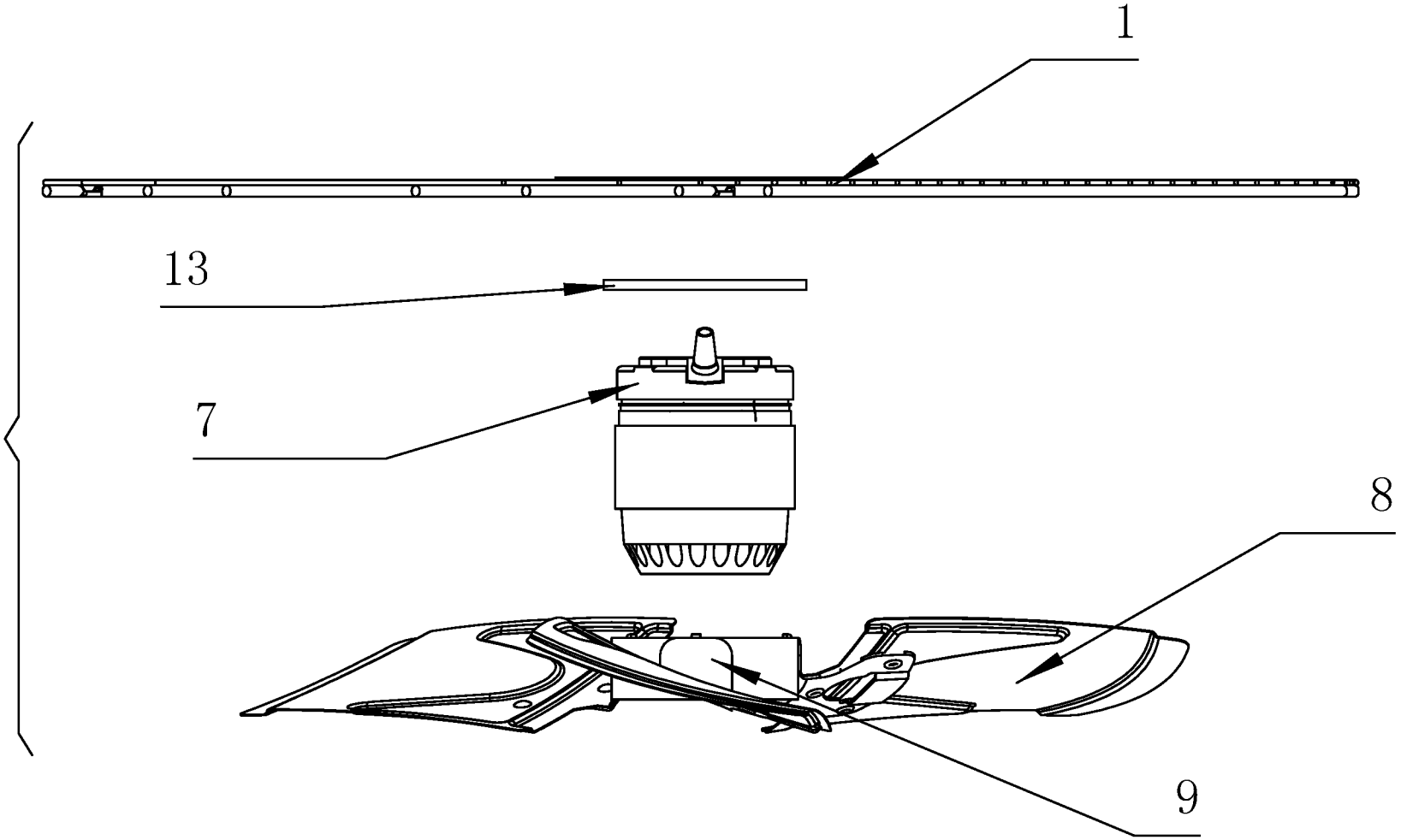
FIG. 7 is an explosive view of part of the heat exchange system in FIG. 2.
Figure 8:
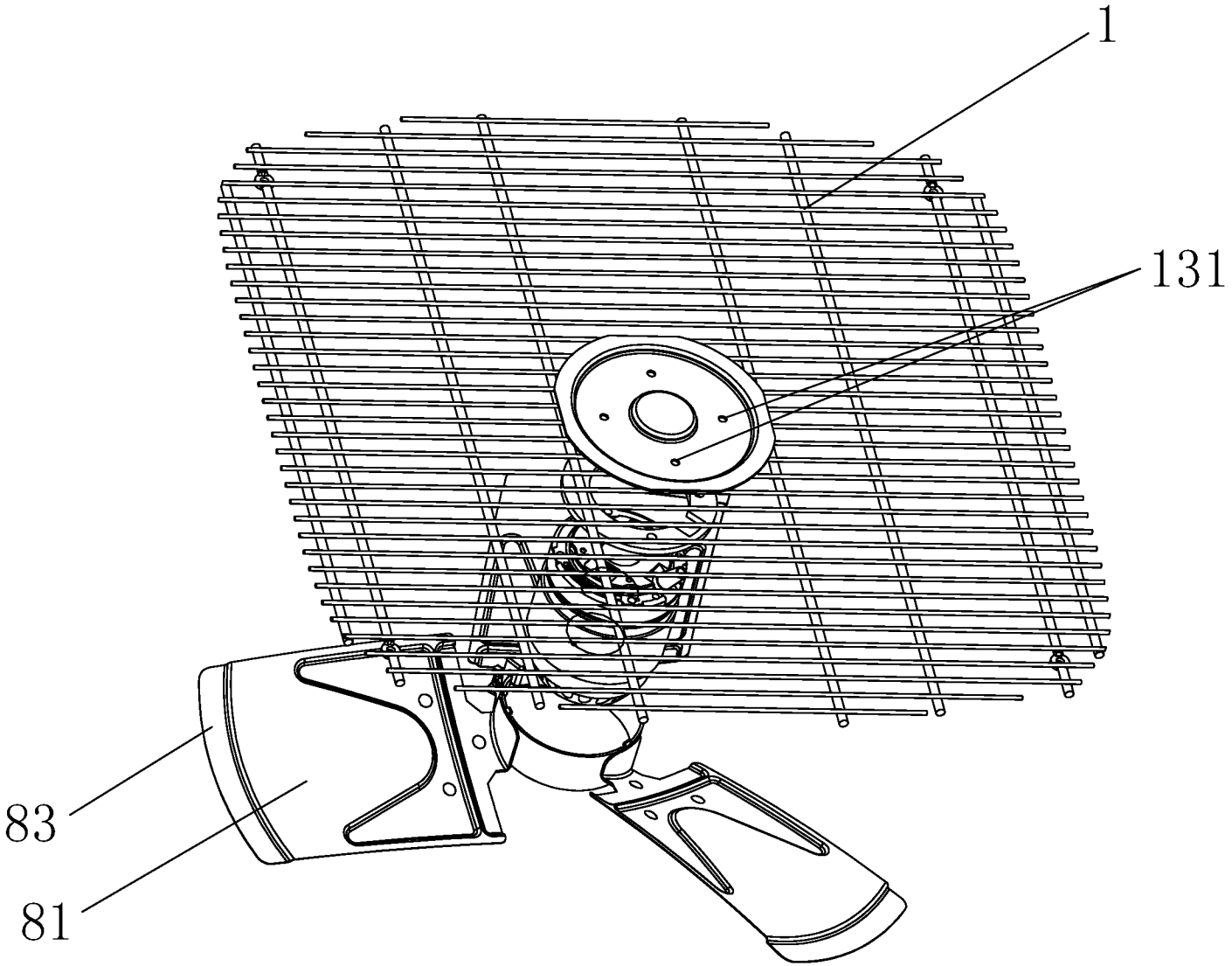
FIG. 8 is another explosive view of the part of the heat exchange system in FIG. 2.
Figure 9:
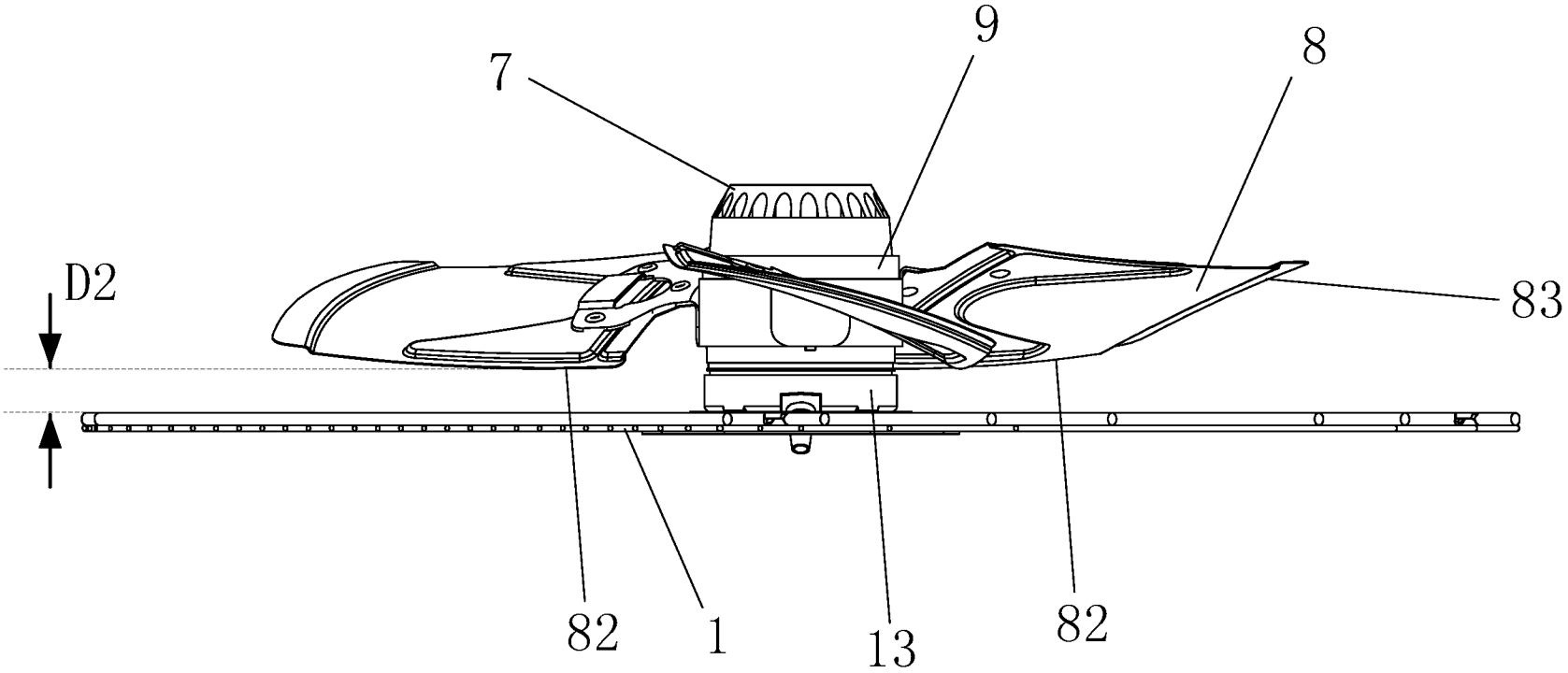
FIG. 9 is a schematic view of the part of the heat exchange system in FIG. 2.
Figure 10A:
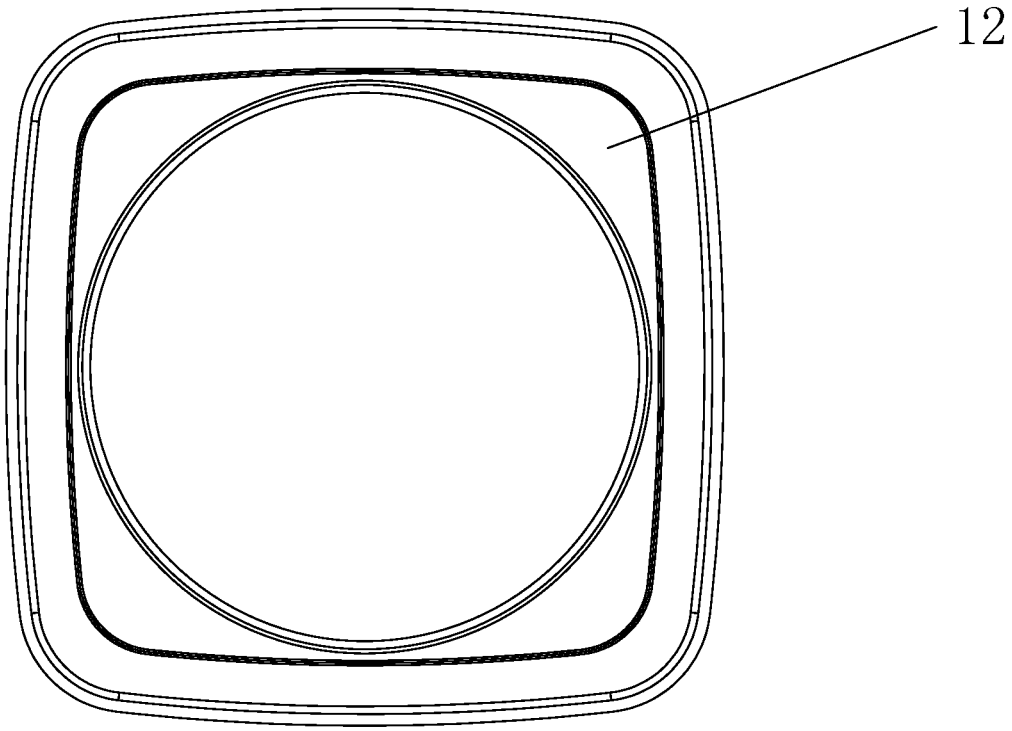
FIG. 10A and 10B are schematic views of an air collecting ring in FIG. 2.
Figure 10B:
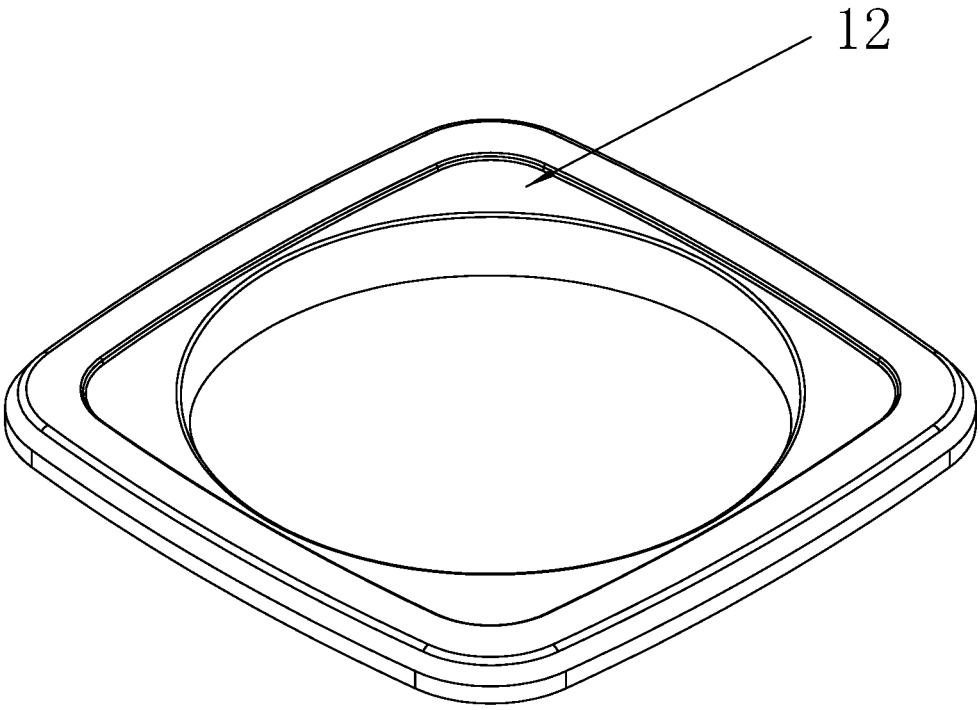
Figure 11A:
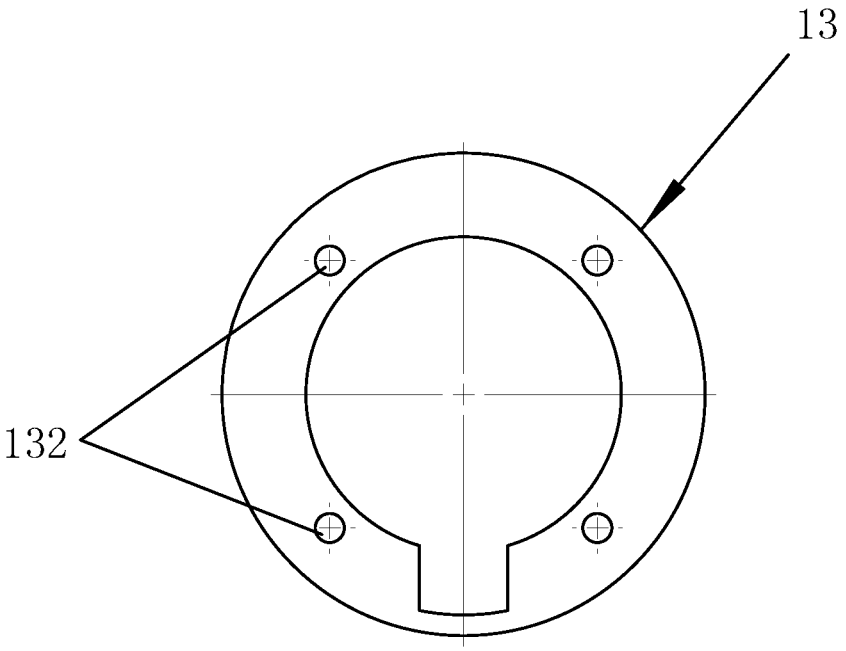
FIGS. 11 A and 11B are explosive views of a shock absorbing pad in FIG. 2.
Figure 11B:
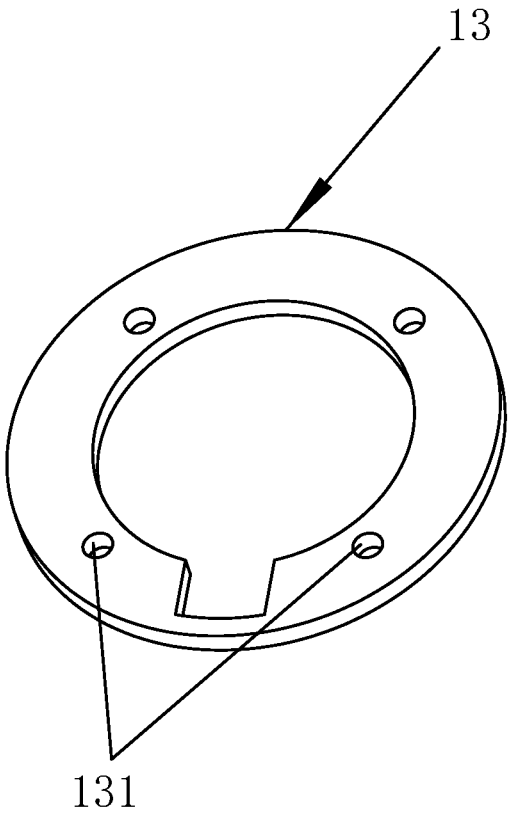

The wind blade 8 is disposed outside the rotor 71 of the external rotor motor 7 via a support 9, the support 9 comprises an annular cylinder 91, and multiple mounting feet 92 extending from the annular cylinder 91, the wind blade 8 is disposed on the mounting foot 92, and the annular cylinder 91 is fit on the rotor 71 of the external rotor motor 7. The wind blade 8 is an equal-width blade and in the vicinity of the exhaust outlet 6 of the box 4. The annular cylinder 91 is a cylinder formed via an annular body with an opening, and specifically is a closed cylinder formed by the annular body with the opening via a fastening device 10. As shown in FIGS. 5 and 6, the external rotor motor comprises a rotor 71 and a stator 72, and inner wall of the annular cylinder 91 is interference fit with outer wall of the rotor 71. A through hole is disposed on the mounting foot 92, and the wind blade 8 is connected to the mounting foot 92 via a rivet 11. The annular cylinder 91 and the mounting foot 92 are integrally formed, or connected to each other as two independent parts via welding, buckling, or riveting.

In addition, the annular cylinder 91 is an integral formed cylinder, or a closed cylinder made via welding. Alternatively, a screw hole is disposed on the wind blade 8, and the wind blade 8 is disposed on the mounting foot 92 via a bolt and a nut. Alternatively, the wind blade 8 is directly welded on the mounting foot 92, or directly welded on the outside of the rotor 71 of the external rotor motor 7. Alternatively, the wind blade 8 is disposed on the mounting foot 92 via buckling The bolt comprises an axis, and the axis of bolt and the axis of the external rotor motor 7 form an angle of substantially 45°.

The shock absorbing pad 13 is in the shape of a circular ring and comprises four holes 131; and a groove for receiving wires is disposed on an inner wall that confines each of the four holes 131. Four screws 132 are respectively disposed in the four holes 131 for connecting the shock absorbing pad 13, the external rotor motor 7, and the multiple grids 1 to one another; and a distance between the center of the shock absorbing pad 13 and each of the four screws 132 is smaller than the external radius of the rotor 71 of the external rotor motor 7.

The outer surface 81 and the axis of the external rotor motor 7 form an oblique angle. An air collecting ring 12 is disposed between the wind blade 8 and the inner side wall 14 and encloses the wind blade 8; and substantially one third of the wind blade 8 along the axis of the external rotor motor 7 is disposed inside the air collecting ring 12.

The side end 83 of the wind blade 8 is spaced from the air collecting ring 12 by a distance D1 of 8-15 mm, and the top end 82 of the wind blade 8 is spaced from the multiple grids by a distance D2 of 110 mm.

The blower 2 of the invention uses the external rotor axial fan that features large rotational inertia, small fluctuation in torsion, and stable operation, and the wind blade 8 is close to the exhaust outlet 6 and has a low wind pressure coefficient, small wind resistance, and high efficiency, which causes the external rotor axial fan to blow large amount of wind from the exhaust outlet 6 of the box 4 and thus improving blowing effect; the heat exchange system features high overall efficiency and low power consumption, and meets requirement of the current society for energy conservation and environmental protection; the wind blade 8 is an equal-width blade with a large area and in the vicinity of the exhaust outlet 6 of the box 4, and thus greatly improving inducing capacity of the external rotor axial fan, and blowing effect of the heat exchange system.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A heat exchange system, comprising:
multiple grids;
a blower; said blower comprising an external rotor motor and a wind blade, said external rotor motor comprising an axis and a rotor, said wind blade comprising an outer surface, a top end, and a side end;
an inner side wall;
a shock absorbing pad;
a compressor; and
a box; said box comprising a side, a bottom surface, an exhaust outlet, and multiple exhaust inlets;
wherein:
said exhaust inlets are disposed on said side of said box;
said multiple grids are disposed at said exhaust outlet of said box;
said blower is disposed in said box and below said multiple grids;
said compressor is disposed on said bottom surface of said box;
said shock absorbing pad is disposed between said multiple grids and said external rotor motor;
said blower is an external rotor axial fan;
said wind blade is disposed outside said rotor of said external rotor motor;
said shock absorbing pad is in the shape of a circular ring and comprises a plurality of holes;
a groove is disposed on an inner wall of each of said plurality of holes for receiving wires; and
a plurality of screws are respectively disposed in said plurality of holes for connecting said shock absorbing pad, said external rotor motor, and said multiple grids to one another; and a distance between a center of said shock absorbing pad and each of said plurality of screws is smaller than an external radius of said rotor of said external rotor motor.

2. The heat exchange system of claim 1, wherein a number of said plurality of holes is four; and a number of said plurality of screws is four.

3. The heat exchange system of claim 1, wherein said outer surface and said axis of said external rotor motor form an oblique angle.

4. The heat exchange system of claim 1, wherein an air collecting ring is disposed between said wind blade and said inner side wall and encloses said wind blade; and substantially one third of said wind blade along said axis of said external rotor motor is disposed inside said air collecting ring.

5. The heat exchange system of claim 1, wherein said side end of said wind blade is spaced from an air collecting ring by 8-15 mm.

6. The heat exchange system of claim 1, wherein said top end of said wind blade is spaced from said multiple grids by 80-140 mm.

7. The heat exchange system of claim 6, wherein said top end of said wind blade is spaced from said multiple grids by 110 mm.

8. The heat exchange system of claim 1, wherein
said wind blade is disposed outside said rotor of said external rotor motor via a support;
said support comprises an annular cylinder, and multiple mounting feet extending from said annular cylinder;
said wind blade is disposed on a mounting foot of the multiple mounting feet; and
said annular cylinder is fit on said rotor of said external rotor motor.

9. The heat exchange system of claim 8, wherein said wind blade is an equal-width blade and in the vicinity of said exhaust outlet of said box.

10. The heat exchange system of claim 8, wherein said annular cylinder is an integral formed cylinder, or a cylinder formed via an annular body with an opening.

11. The heat exchange system of claim 8, wherein an inner wall of said annular cylinder is interference fit with an outer wall of said rotor.

12. The heat exchange system of claim 8, wherein
a screw hole is disposed on said mounting foot; and
said wind blade is disposed on said mounting foot via a bolt and a nut.

13. The heat exchange system of claim 12, wherein said bolt comprises an axis, and said axis of said bolt and said axis of said external rotor motor form an angle of substantially 45°.

14. The heat exchange system of claim 8, wherein
a through hole is disposed on said mounting foot; and
said wind blade is connected to said mounting foot via a rivet.

15. The heat exchange system of claim 8, wherein said wind blade is directly welded on said mounting foot, or directly welded on an outer wall of said rotor of said external rotor motor.

16. The heat exchange system of claim 8, wherein said wind blade is disposed on said mounting foot via buckling.

17. The heat exchange system of claim 8, wherein said annular cylinder and said mounting foot are integrally formed, or connected to each other as two independent parts via welding, buckling, or riveting.

* * * * *